US005100150A

United States Patent [19]

Larman

[11] Patent Number: 5,100,150

[45] Date of Patent: Mar. 31, 1992

[54] WORD FORMING BOARD GAME WITH ROTATABLE TWO LEVEL BOARD AND CHANCE DEVICE

[76] Inventor: Darryl S. Larman, 3725 Sheridan Ave., Miami Beach, Fla. 33140

[21] Appl. No.: 650,465

[22] Filed: Feb. 4, 1991

[51] Int. Cl.[5] ..... A63F 3/00

[52] U.S. Cl. ..... 273/272; 273/280; 273/243; 273/287

[58] Field of Search ..... 273/239, 241, 272, 280, 273/282, 284, 287, 299

[56] References Cited

U.S. PATENT DOCUMENTS

| | | | |
|---|---|---|---|
| D. 223,540 | 5/1972 | Kayle | 273/241 |
| 3,117,789 | 1/1964 | Wiebe | 273/272 |
| 3,524,648 | 8/1970 | Nilan | 273/239 |

FOREIGN PATENT DOCUMENTS

| | | | |
|---|---|---|---|
| 1208246 | 2/1960 | France | 273/272 |
| 0130915 | 8/1919 | United Kingdom | 273/282 |
| 0667737 | 3/1952 | United Kingdom | 273/241 |

*Primary Examiner*—Edward M. Coven
*Assistant Examiner*—William M. Pierce
*Attorney, Agent, or Firm*—Irwin Ostroff

[57] ABSTRACT

A word game assembly for play by two or more players includes for each player a play grid of horizontal and vertical rows of adjacent areas and a supply of alphabetical letter designating play pieces receivable on the grid areas in a competitive attempt to form words. A player operated random selector and indicator device, such as a spinnable top having side facets marked with different symbols, is used to determine the nature and procedure of play for effecting a series of plays. For instance, each player may select play pieces and place them on an associated play grid to form words in dependence upon the indicated random selection resulting from a spin of the top. In one embodiment of the word game assembly, a portion of the play grid is rotatable.

5 Claims, 1 Drawing Sheet

WORD FORMING BOARD GAME WITH ROTATABLE TWO LEVEL BOARD AND CHANCE DEVICE

FIELD OF THE INVENTION

This invention relates to a word game assembly for random selection play by two or more players.

BACKGROUND OF THE INVENTION

Competitive crossword games and other word games generally involve the placing by the players of letters of the alphabet, such as by marker or letter designating play pieces, on squares of a grid pattern or "checkerboard" play board, in an attempt to form words. These games are typically governed by player knowledge, skill or intentional selection, during a series of plays, while minimizing or eliminating the element of chance.

Sherman et al. U.S. Pat. No. 4,850,595 shows a crossword game having a six sided die with special indicia to denote the number of letters to be filled in on a standard replaceable crossword puzzle. Each player in turn rolls the die and attempts to add a word to the puzzle. Scoring is based on the length of words filled in by each player. Winning is governed more by player knowledge than by chance.

White et al. U.S. Pat. No. 4,420,157 shows a crossword game for only two players, conducted under a stated set of rules. Each player picks a given number of play pieces, each having an alphabetical letter designation and an assigned scoring value, the identity of some play piece letters picked by one player not being disclosed to the other. The players in turn place their pieces on a common crossword grid play board to form conjoined words, and note the score. The process is repeated a series of times to complete a game. The game is conducted so as to eliminate the element of chance.

Lissandrello U.S. Pat. No. 3,165,318 shows a word game in which each player has a "checkerboard" grid play board with recessed pockets to receive alphabetical letter designating play pieces for forming words. Each player in turn selects a number of identical play pieces equal to the number of players from preset stacks of play pieces having the various letters, keeping one and distributing the others to each of the other players. The players then place the play pieces in a pocket of their respective play boards in an attempt to form words. The game ends when all pockets are filled, scoring being based on the number and type words formed on each play board. This game is governed by intentional play piece selection by each player.

Rudell U.S. Pat. No. 4,776,597 shows a word game using a single play board with a waffle pattern of raised square shaped bosses on which alphabetical letter designating play pieces are to be stacked. Each play piece has a complemental offset square shoulder on its top side surrounding the letter designation, and a depending peripheral square skirt on its bottom side, for interlocked stacking on the play board bosses and onto one another thereon, to form words. Each player draws an equal number of play pieces from a pile. The players then take turns in attempting to form words. Scoring is based on the height of the stacks, assumably after the turn of each player. This game does not involve the element of chance.

It is desirable to have a word game for two or more players that involves random play selection for introducing an element of chance into a word game.

SUMMARY OF THE INVENTION

In accordance with the present invention, a word game assembly is provided for play by two or more players that involves random play selection in attempting to form words, and thus introduces an element of chance into the game. The assembly comprises a combination of cooperating components.

The assembly comprises a plurality of play grids, one for each of at least two players, a supply of a plurality of individual alphabetical letter designating play pieces, and a player operated random selector and indicator means.

Each play grid defines a plurality of adjacent discrete areas arranged in a crosswise grid pattern of generally horizontal and vertical rows, each area being capable of receiving a corresponding play piece. Each play piece has a top side containing a single alphabetical letter designation and a bottom side free from such designation. The random selector and indicator means is operatable manually to select at random an individual one of a plurality of alternative play selections and to indicate the selected play selection.

This permits a selective series of plays in which each player in turn operates the random selector and indicator means for successive play piece selection from the supply of play pieces, in dependence upon indicated play selection, and selected play piece location on an area of the play grid of that player, in a competitive attempt to form words on the play grid, in accordance with preassigned scoring values, consequent successive turns in the series of plays. The winner is the player having the highest score at the end of the play series.

The random selector and indicator means particularly comprises a spinnable top having a manually twistable top end spindle, a convex bottom end pivot and a plurality of opposing side facets marked with individually different symbols.

According to one embodiment, each play grid comprises a play board having a local indentation in each area, and the bottom side of each play piece has a cooperating local protuberance sized and shaped to be received releasably in the indentation of a respective area for correspondingly stationarily affixing the play pieces on the areas.

According to another embodiment, each play grid comprises a play board, such that the play boards have areas comprising one of (a) magnetic material or (b) magnetizable material, and the play pieces correspondingly comprise the other of (a) magnetic material or (b) magnetizable material. Thus, the play boards may be of magnetic material and the play pieces o magnetizable material, or the play pieces may be of magnetic material and the play boards of magnetizable material.

The word game assembly may include a separate associated supply of a plurality of individual alphabetical letter designating play pieces for each play grid, and each play grid and its play piece supply may be provided with matching indicia, e.g., a matching color, to distinguish them from each of the other play grids and play piece supplies.

Each play grid typically has a grid pattern of at least five corresponding horizontal and vertical rows of areas.

In accordance with one specific embodiment, the assembly contemplates a plurality of play boards, one for each of at least two players, a said supply of letter designating play pieces, an associated overlay board provided on each play board for rotation relative thereto, and a said random selector and indicator means. Each play board defines a plurality of said discrete areas in a grid pattern of horizontal and vertical rows, each area being capable of receiving a corresponding play piece. Each play piece has a top side containing a said letter designation and a bottom side free from such designation.

Each overlay board is of smaller size than its associated play board, and defines a series of adjacent discrete counterpart areas of complemental size and shape to the play board areas. The counterpart areas are arranged in a counterpart crosswise grid pattern of generally horizontal and vertical rows, each counterpart area being capable of receiving a corresponding play piece. The series of counterpart areas is smaller in number in each horizontal and vertical row than the plurality of areas of the associated play board.

The overlay board is rotatable relative to the play board from one position of rotation in which the counterpart areas are individually superimposed on and aligned with respective ones of an equal number of corresponding areas therebelow on the associated play board, to another position of rotation in which the counterpart areas are individually superimposed on and aligned with other respective ones of such equal number of the same corresponding areas therebelow on the play board.

In the series of plays, each player in turn operates the random selector and indicator means for successive play piece selection from the supply of play pieces, in dependence upon indicated play selection, and selected play piece location on an area of the play board or on a counterpart area of the associated overlay board of that player, subject to rotation of the overlay board from one position of rotation to another such position so as to change the arrangement of the areas and counterpart areas, also in dependence upon indicated play selection, in a competitive attempt to form words on the play board and its associated overlay board.

The overlay board may be rotatably secured to the play board by a resilient connector to permit lifting of the overlay board a selective height above the play board remote from any play pieces located thereon for rotation at that height. The overlay board may instead be rotatably secured to the play board by a pivotal connector arranged to space the overlay board a selective height above the play board remote from any play pieces located thereon for rotation at that height. Also, the overlay board may be removably secured to the play board by a releasable band connector for rotation of the overlay board upon release of the band connector.

Each play board typically has a grid pattern of at least five corresponding horizontal and vertical rows of areas, and its associated overlay board has a counterpart grid pattern of at most three corresponding horizontal and vertical rows of counterpart areas, the overlay board being disposed generally centrally on the corresponding play board.

Viewed from one aspect, the present invention is directed to a word game which can be played by two or more players. The word game comprises a plurality of play grids, one for at least each of two players, a plurality of play pieces with each having an alphabetical letter, and a random selector and indicator means. The random selector and indicator means comprises a preselected plurality of symbols which define alternative play selections which are determinative of the number of play pieces a player selects from the plurality of play pieces. Each play grid defines a plurality of areas arranged in a predetermined pattern with each area being designed to receive a play piece.

Viewed from another aspect, the present invention is directed to a word game which can be played by two or more players. The word game comprises a plurality of play grids, one for at least each of two players, a plurality of play pieces with each having an alphabetical letter, and a random selector and indicator means. Each play grid defines a plurality of areas arranged in a predetermined pattern with each area being designed to receive a play piece and has a portion thereof which comprises areas that are adapted to be rotated relative to other areas of the play grid. The random selector and indicator means comprises a preselected plurality of symbols which define alternative play selections which are determinative of the number of play pieces a player selects from the plurality of play pieces and rotation of the rotatable portions of the play grids.

The invention will be better understood from the following more detailed description taken with the accompanying drawings.

It is to be noted that the drawings are not to scale, some portions being exaggerated to make them easier to understand.

DETAILED DESCRIPTION

Figure 2:
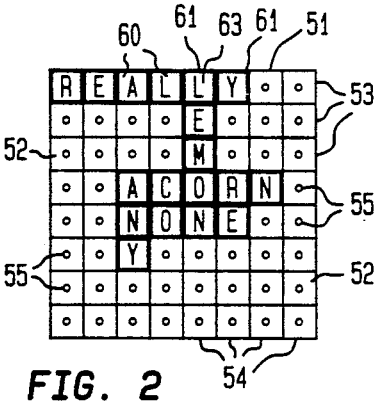
FIG. 2 is a top view of a play board usable in the word game assembly of the invention.
Figure 3:
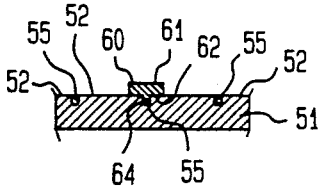
FIG. 3 is a sectional view of a portion of the play board of FIG. 2.
Figure 1:
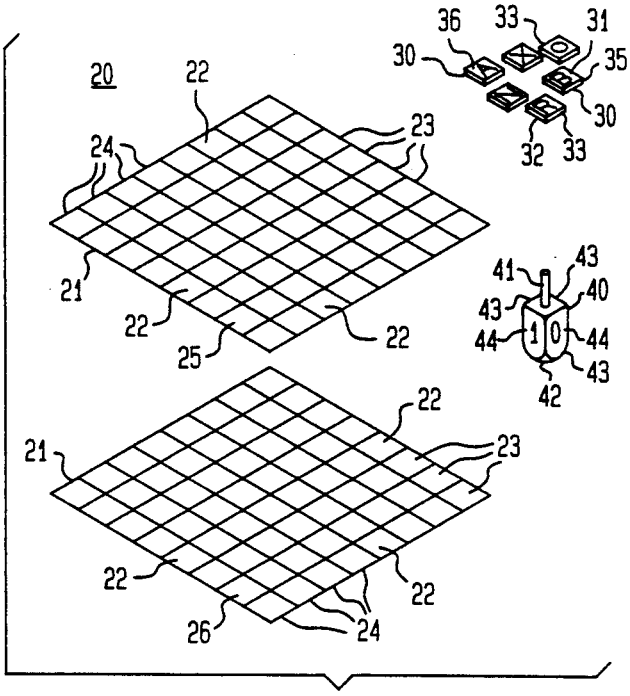
FIG. 1 is a perspective view of a word game assembly according to one embodiment of the invention, including play grids, play pieces and a random selector and indicator device.
Figure 4:
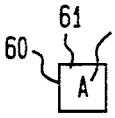
FIGS. 4, 5 and 6 show, respectively, a top view, a bottom view and a side view, of a play piece usable on the play board of FIG. 2.
Figure 5:
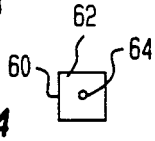
Figure 6:
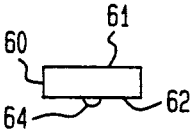

Referring now to FIG. 1. a word game assembly 20 is shown according to one embodiment of the invention, for play by two or more players. Assembly 20 includes a plurality of play grids 21 (only two play grids are shown), one for each player, a supply of a plurality of individual alphabetical letter designating play pieces 30, locatable on play grids 21 to form words during play, and a player operated random selector and indicator means (device) such as spinnable toy top (e.g., a dreidel) 40 to determine and control the nature and procedure of each play.

Each play grid 21 defines a plurality of adjacent discrete areas 22 arranged in a crosswise (regular) grid pattern (checkerboard) of generally horizontal rows 23 and concordant vertical rows 24. Each play grid 21 desirably has a grid pattern of at least five corresponding horizontal rows 23 and vertical rows 24 of areas 22 (eight rows of each being shown). Each area 22 is capable of receiving a play piece 30 thereon. Play grids 21 are typically made of cloth fabric, e.g., felt cloth, cardboard, wood, plastic, metal, or the like, and are normally used on a table or other support surface (not shown).

Each play piece 30 has a top side 31 containing a single alphabetical letter designation 33, i.e., the letter "A", "B", "C", etc., and a bottom side 32 free from such letter designations, thus forming a "blank" side. The supply of play pieces 30 is typically arranged in a pile with each blank bottom side 32 facing upwardly (not shown), so that the identity of the letters on the top sides 31 of respective play pieces 30 in the pile remains undisclosed. Play pieces 30 are typically made of cardboard, wood, plastic, metal, or the like.

Top 40 has a manually twistable top end spindle 41, a convex bottom end pivot 42 and a piurality of, e.g., four, opposing side facets 43 marked with individually different symbols 44 such as "0", "1", "2" and "3", e.g., forming a square sided top configuration. Top 40 is typically made of wood, plastic, metal, or the like.

Figure 7:
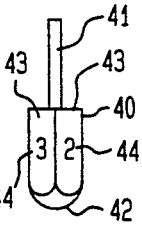
FIG. 7 is an enlarged side view of the random selector and indicator device shown in FIG. 1.

Referring now to FIG. 7, there is shown an enlarged view of the top 40 which is operatable manually to select at random an individual one of a plurality of alternative play selections respectively corresponding to symbols 44 and to indicate the selected play selection, e.g., play selection "0", "1", "2" or "3", to permit a selective series of plays to take place. Specifically, when top 40 completes its spinning action, upon being twirled by a player grasping and twisting spindle 41 on a table or other support surface (not shown), it comes to rest on the surface randomly on one of its side facets 43, e.g., "1", so that the diametrically opposite side facet 43, e.g., "3", faces upwardly, thereby automatically indicating play selection "3" as the random selection for that spin (play).

Top 40 is much more desirable for use in playing a word game with assembly 20, than would be the case if a die were used instead to select and indicate play selections. This is because a die has six sides and can be readily manipulated by a proficient or manually dexterous player to influence the result of a die "throw", by predetermined positioning of the die in the hand, with its sides in a favored orientation, and then tossing the die in a guided trajectory to increase the chances of the die coming to rest on a surface with a desired die side facing upwardly as the indicated selection. On the other hand, by using top 40, a true random selection is achieved, as the player obviously cannot easily influence the result of a "spin".

Use of top 40 is likewise much more desirable than use of a coin that is "tossed" to achieve play selections, not only because a proficient or manually dexterous player can often influence which coin side faces upwardly after the toss, but also because use of a coin limits the alternative selections to only two possibilities, i.e., either "heads" or "tails".

In conducting a series of plays, each player in turn operates top 40 as the random selector and indicator means for successive play piece selection from the supply of play pieces 30, in dependence upon the indicated play selection, e.g., "0", "1", "2" or "3". The selected play piece 30 is then located on an area 22 of the play grid 21 of that player, in a competitive attempt to form words on that play grid 21, in accordance with preassigned scoring values, consequent successive turns in the series of plays. The winner may be chosen as the player having the highest value score at the end of the series of plays.

For instance, if the indicated play selection is "0", this may signify that the player loses a turn. If the selection is "1", "2" or "3", this may signify that the player may select one, two or three play pieces 30, respectively, for placement on any areas 22 of the play grid 21 of the player in that turn.

Assembly 20 may include a separate associated supply of a plurality of individual alphabetical letter designating play pieces 30 for each play grid 21, with each play grid 21 and its supply of play pieces 30 being provided with matching indicia to distinguish them from each of the other play grids 21 and their respective supplies of play pieces 30. Thus, one play grid 21 may have indicium 25 and its supply of play pieces 30 may have matching indicium 35, signifying that they are to be used by one player, and another play grid 21 may have indicium 26 and its supply of play pieces 30 may have matching indicium 36, signifying that they are to be used by another player.

For example, indicia 25 and 35 may signify one matching color, e.g., red, for a given play grid 21 and supply of play pieces 30 for one player, while indicia 26 and 36 signify another matching color, e.g., green, for a given play grid 21 and supply of play pieces 30 for another player. Although the supplies of different indicia (different color) play pieces 30 may be mixed together in the pile of play pieces 30 used during play, e.g., with their blank bottom sides 32 facing upwardly, each player can readily select only those play pieces 30 of the given indicium (color) associated with that player.

Referring now to FIGS. 2, 3, 4, 5 and 6, according to one constructional embodiment of the invention, each play grid 21 is in the form of a play piece affixing play board 51, e.g., of self-supporting cardboard, wood, plastic, metal, or the like. Each play board 51 has adjacent discrete areas 52 arranged in a grid pattern of (e.g., eight) horizontal rows 53 and (e.g., eight) concordant vertical rows 54. Each play board 51 also has a local hole-like small indentation 55 (pocket or depression) in each area 52.

For use therewith, each play piece 30 is in the form of an affixable play piece 60 having a top side 61 containing a given letter designation 63, and a bottom side free from such letter designations. Each play piece 60 also has a cooperating local nipple-like small protuberance 64 (projection) sized and shaped to be received releasably in the indentation 55 of a respective area 52 for stationarily affixing the play piece 60 thereon.

Typically, indentations 55 are centrally located in areas 52, and protuberances 64 are centrally located on the bottom sides 62 of play pieces 60 for centered positioning of play pieces 60 on areas 52.

Figure 8:
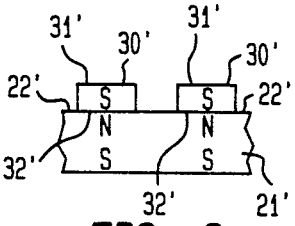
FIG. 8 is a side view of a portion of a play board receiving play pieces thereon under magnetic action, according to another embodiment of the invention.

Referring now to FIG. 8, according to another constructional embodiment of the invention, each play grid 21 is provided as a magnetic action play piece affixing play board 21', e.g., of metal. Each play board 21' has adjacent discrete areas 22' arranged in a crosswise grid pattern of horizontal rows and vertical rows (not shown), in a manner similar to play grids 21 as shown in FIG. 1. For use therewith, each play piece 30 is provided as a magnetic action affixable play piece 30', e.g., also of metal. Each play piece 30' has a top side 31' containing a given letter designation (not shown) and a bottom side 32' free from letter designations, in a manner similar to play pieces 30 as shown in FIG. 1.

In one case, each play board 21' may have areas 22' of magnetic (metal) material while each play piece 30' may be of magnetizable (metal) material. In the other case, each play piece 30' may be of magnetic (metal) material while each play board 21' has areas 22' of magnetizable (metal) material. As shown in FIG. 8, assuming that each play board 21' has its north pole N located adjacent its top surface, and that each play piece 30' has its south pole S located adjacent its bottom side 32', the attendant magnetic action will affix each play piece 30' on its selected area 22' of the corresponding play board 21' in removably stationary manner.

Figure 9:
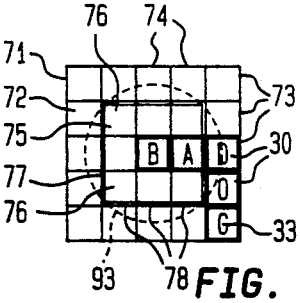
FIG. 9 is a top view of an arrangement of a play board having an overlay board rotatably positioned thereon, according to a further embodiment of the invention.
Figure 10:
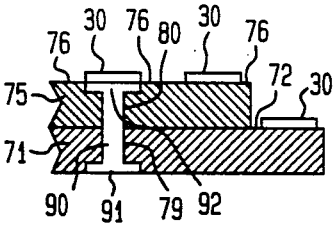
FIG. 10 is a sectional view of a portion of the arrangement of FIG. 9, illustrating details.
Figure 11:
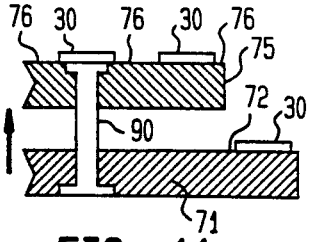
FIG. 11 is sectional view corresponding to FIG. 10, but showing the overlay board lifted from the play board.

Referring now to FIGS. 9, 10 and 11, according to a further constructional embodiment of the invention, each play grid 21 is provided as a play board 71, e.g., of cardboard, wood, plastic, metal, or the like, having adjacent discrete areas 72 arranged in a crosswise grid pattern of, e.g., at least five, corresponding horizontal rows 73 and vertical rows 74 of areas 72, for use with the supply of play pieces 30 shown in FIG. 1. In this case, an associated overlay board 75, e.g., also of cardboard, wood, plastic, metal, or the like, is provided on each play board 71 for rotation relative thereto.

Each overlay board 75 is of smaller size than its associated play board 71, and defines a series of adjacent discrete counterpart areas 76 of complemental size and shape to the play board areas 72. The counterpart areas 76 are arranged in a counterpart crosswise grid pattern of generally horizontal rows 77 and vertical rows 78, each counterpart area 76 being capable of receiving a corresponding play piece 30 thereon. The series of counterpart areas 76 is smaller in number in each horizontal and vertical row than the plurality of areas 72 of the associated play board 71, e.g., at most three rows of areas 76 are provided in overlay board 75 compared to five rows of areas 72 in play board 71 as shown in FIG. 9.

Overlay board 75 is rotatable (e.g., manually) relative to play board 71 from one position of rotation in which counterpart areas 76 are individually superimposed on and aligned with respective ones of an equal number of corresponding areas 72 therebelow on play board 71, e.g., nine as shown in FIG. 9, to another position of rotation in which counterpart areas 76 are individually superimposed on and aligned with other respective ones of such equal number of the same corresponding areas therebelow on play board 71. For instance, overlay board 75 may be rotated a quarter turn in clockwise direction relative to the orientation of overlay board 75 as shown in FIG. 9, to a new position in a given play.

With this arrangement of overlay board 75 on play board 71, top 40 is operated in the same way as described above, for successive play piece selection from the supply of play pieces 30, in dependence upon indicated play selection, and selected play piece location on an area 72 of play board 71 or on a counterpart area 76 of overlay board 75. However, in this case the play is subject to rotation of overlay board 75 from one position of rotation to another such position so as to change the arrangement of areas 72 and counterpart areas 76, also in dependence upon indicated play selection, i.e., in an attempt to form words on play board 71 and overlay board 75.

For instance, if top 40 randomly selects symbol "0", this may signify that the overlay board 75 must be rotated a quarter turn clockwise on the play board 71 of a given player.

As shown in FIG. 10, overlay board 75 may be rotatably secured to play board 71 by a resilient connector 90, e.g., a stretchable rubber band type connector, having a bottom journal flange 91 and a top journal flange 92. Resilient connector 90 passes through a bore 79 in the centermost area 72 of play board 71 and an aligned counterpart bore 80 in the centermost counterpart area 76 of overlay board 75, with its bottom flange 91, e.g., rotatably, seated in the bottom surface of play board 71 and its top flange 92, e.g., rotatably, seated in the top surface of overlay board 75.

As shown in FIG. 11, this arrangement permits lifting of overlay board 75 a selective height above play board 71 remote from any play pieces 30 located thereon, by temporarily stretching resilient connector 90 for rotation of overlay board 75 at that height. In this way, as shown in FIG. 9, the corners of overlay board 75 will clear any play pieces 30 on area 72 of play board 71 adjacent those covered by overlay board 75 as the latter is rotated to move those corners in their circular path 93 (indicated in dashed line).

When overlay board 75 is returned to its new position of rotation on play board 71, under the compression action of resilient connector 90, the orientation of those letter containing play pieces 30 on counterpart areas 76 of overlay board 75 will be correspondingly changed relative to those play pieces 30 on adjacent areas 72 of play board 71. It is desirable after the board 75 is rotated to rotate the play pieces 30 within the areas of the overboard 75 so as to make it easier to read these letters in conjunction with the letters of the play pieces on the non-rotatable portions of the play board 71.

Figure 12:
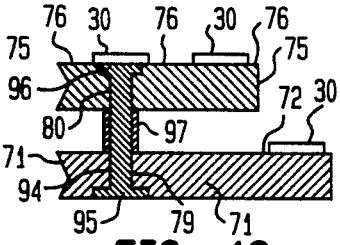
FIG. 12 is a sectional view of a portion of another play board and overlay board arrangement according to the invention.

Referring now to FIG. 12, according to a still further constructional embodiment of the invention, resilient connector 90 may be replaced by a pivotal connector 94 (shaft) for rotatably securing overlay board 75 to play board 71. Pivotal connector 94 has a bottom journal flange 95 and a top journal flange 96, and is provided with a central spacing collar 97. Pivotal connector 94 passes through bore 79 in play board 71 and counterpart bore 80 in overlay board 75, with its bottom flange 95, e.g., rotatably, seated in the bottom surface of play board 71, its top flange 96, e.g., rotatably, seated in the top surface of overlay board 75, and its collar 97 located as a spacer between play board 71 and overlay board 75.

This arrangement of collar 97 between play board 71 and overlay board 75 permanently maintains overlay board 75 a selective height above play board 71 remote from any play pieces 30 located thereon, for rotation at that height. Hence, the corners of overlay 75 will always clear any play pieces 30 on areas 72 of play board 71 adjacent those covered by overlay board 75 as overlay board 75 is rotated to move those corners in their path 93 (indicated in dashed line in FIG. 9).

Figure 13:
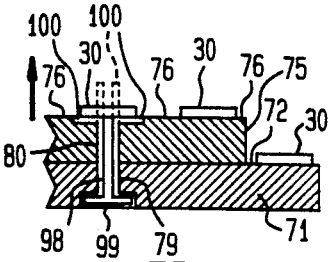
FIG. 13 is a sectional view of a portion of still another play board and overlay board arrangement according to the invention.

Referring now to FIG. 13, according to yet another constructional embodiment of the invention, resilient connector 90 may be replaced by a bendable metal band (strap) connector 98 for removably securing overlay board 75 to play board 71. Band connector 98 is folded in half on itself to provide a pair of doubled over, transverse flat bottom seating prongs 99 and a pair of transverse flat top seating wings 100. Band connector 98 passes through bore 79 in play board 71 and counterpart bore 80 in overlay board 75, with its bottom prongs 99 seated in the bottom surface of play board 71, and its top wings 100 spread apart and seated in the top surface of overlay board 75.

Band connector 98 may be in the form of a typical doubled over, pointed end, stationary strap type clip used to bind a stack of sheets of paper together, upon passing its pointed ends upwardly through aligned holes in the sheets and then bending the pointed ends as wings outwardly over the top sheet.

This arrangement of band connector 98 permits upward bending of top wings 100 to vertical position (shown in dashed line) for temporarily lifting overlay board 75 to a selective height above play board 71 remote from any play pieces 30 located thereon, for rotation at that height. In this case as well, the corners of overlay 75 will clear any play pieces 30 on areas 72 of play board 71 adjacent those covered by overlay board 75 as the latter is rotated to move those corners in their path 93 (indicated in dashed line in FIG. 9).

The grid pattern of each play board 71 desirably has at least five horizontal rows 73 and vertical rows 74 of areas 72, and the counterpart grid pattern of its overlay board 75 has at most three horizontal rows 77 and vertical rows 78 of counterpart areas 72. The number of such rows is desirably an odd number in both instances, whereby each overlay board 75 may be disposed centrally on its play board 71, with the given connector 90, 94 or 98 located in the centermost area 72 of play board 71 and the centermost counterpart area 76 of overlay board 75 for uniformity of play operation.

Where overlay board 75 is mounted permanently on play board 71, e.g., by resilient connector 90 (FIGS. 10 and 11), or pivotal connector 94 (FIG. 12), those areas 72 permanently covered by overlay board 75 may be omitted from the grid pattern of play board 71 as they are not used during play.

On the other hand, where overlay board 75 is mounted removably on play board 71, e.g., by band connector 98 (FIG. 13), those areas 72 covered by overlay board 75 may be retained in the grid pattern of play board 71. Even though these covered areas 72 are not used during play with overlay board 75 intact, it is clear that the arrangement using band connector 98 is convertible. Thus, it may be converted to play a game without overlay board 75, by bending top wings 100 upwardly to release and remove overlay board 75 from play board 71.

Of course, each of the arrangements having overlay board 75 may be used in the same way as a play grid 21 that has no overlay board 75, i.e., by not rotating the latter during play.

It is apparent that other means may be used to mount each overlay board 75 rotatably on its play board 71 for the noted purposes. Also, other forms of play grids 21 and play pieces 30 may be provided, so long as the noted purposes are attained.

The crosswise grid pattern on each play grid, play board and/or overlay board of assembly 20 may be formed of lines, e.g., printed, on the top surface thereof, or provided as a printed pattern on a cover sheet adhered to such surface in the manner of a game board used to play chess or checkers.

In one method of playing a word game with assembly 20, without use of overlay boards 75, each player is assigned a play grid 21 and a supply of play pieces 30 of a given color. For instance, if there are two players, one may have a red play grid 21 and a supply of red play pieces 30, and the other may have a green play grid 21 and a supply of green play pieces 30. The two supplies of play pieces 30 may be combined together in a common pile, with their blank bottom sides 32 facing upwardly (letter side face down), so that the players are unaware beforehand of the individual letter designations 33 thereon.

Top 40 is twirled by each player to determine the order of play, e.g., with the player receiving the higher number (symbol 44) indicated by top 40 (i.e., "0", "1", "2" or "3") being the first to play.

Top 40 is then twirled by each player in turn to determine the number, if any, of play pieces 30 to be taken from the pile for that play. Thus, if top 40 indicates the number (symbol 44) "0", the player loses a turn. If it indicates "1", "2" or "3", the player picks one, two or three play pieces 30, as the case may be, from the pile. Play pieces 30 are picked randomly without knowing their letter identities beforehand, and are placed on any unoccupied area 22 of the given play grid 21.

It is clear that top 40 controls the nature and procedure of each play in true random manner, i.e., by chance. As play pieces 30 are arranged in the pile with their blank bottom sides 32 facing upwardly, so that the players are unaware of their letter designations 33, an additional element of chance is introduced into the game. Even if the game is played with the top sides 31 of the play pieces 30 facing upwardly in the pile, indicating their letter designations 33 (letter side face up), as shown in FIG. 1, top 40 still basically controls the nature and procedure of each play in true random manner.

As to rules, once placed on an area 22, a play piece 30 may not be switched to another area 22 on the play grid 21. The players take turns in spinning top 40, and picking and placing their play pieces 30 on their respective play grids 21 in an attempt to form words, using any strategy they choose. A word may be formed horizontally, vertically or diagonally in areas 22 across a play grid 21, but are read from left to right or top to bottom only, and not in reverse order. The game ends when the first play grid 21 is filled with play pieces 30.

In this word game, top 40 is used to determine the number, if any, of play pieces 30 that a player may select in each turn of play, enabling one player to fill his or her play grid 21 before the other player does, thereby ending the game.

Scoring is effected by counting the number of words that have been formed on the respective play grids 21 by the placed play pieces 30. For instance, five points may be awarded for every letter in a word. Proper nouns and names of living or deceased persons may or may not be counted, depending on prior player agreement. Words may be challenged by the opposing player using a prior agreed upon dictionary or other source.

Figure 14:
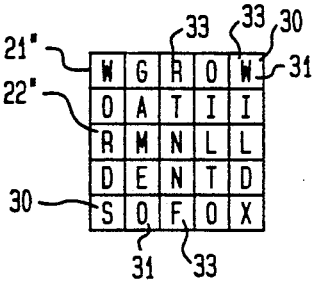
FIG. 14 is a top view of a play grid filled in with play pieces to form certain words.

Referring now to FIG. 14, a filled in play grid 21" is shown that exemplifies game scoring, counting each letter of each formed word on areas 22" as five points. The scores of the words in the horizontal rows are as follows: 20 points for "GROW", 15 points for "OAT", 20 points for "DENT" and 15 points for "FOX", for a horizontal row total of 70 points. Those of the words in the vertical rows are as follows: 25 points for "WORDS", 20 points for "GAME", 15 points for "OIL", 10 points for "TO" and 20 points for "WILD", for a vertical row total of 90 points. The only diagonal row word is "WANT" and its score is 20 points. The game score totals 180 points (70+90+20).

In a method of playing a word game, with each player using a play board 71 having an overlay board 75, the same procedure is followed as described above. However, in this case, if top 40 indicates a "0" number (symbol 44) after spinning, the overlay board 75 must be rotated clockwise a quarter turn (90°) on the play board 71 of that player, thereby disturbing the pre-existing orientation of any play pieces 30 forming words on areas 72 and counterpart areas 76. At the same time, as before, the player loses a turn at picking any play pieces 30 because top 40 randomly selected a "0" number.

Even so, if a player receives four "0" number indications on cumulative spins of top 40 during a series of plays, the successive four quarter turns of overlay board 75 will return it to its original orientation, thereby redeeming that player from the intervening disturbance caused by rotation of overlay board 75 consequent the random selections of top 40.

Variations in the word games that can be played with assembly 20 include assigning different score values to certain letters or kinds of words, loss of points (penalty) for erroneous challenge of formed words, time limits per turn of play or per game, use of specified bonus point "blank" letters on some play pieces 30 as "wild" letters to designate any player desired letter, the players concealing their play grids 21 from each other until the end of the game, and the like.

With play boards 21" having five horizontal rows and five vertical rows for a total of twenty-five areas 22" (FIG. 14), the supply of play pieces 30 for each player may have, e.g., as to the English language alphabet, at least two of each of the twenty-one consonants and at least four of each of the five vowels, for a total of sixty-two potentially usable letters.

With play boards 51 having eight horizontal rows and eight vertical rows for a total of sixty-four areas 52 (FIG. 2), the supply of play pieces 60 for each player will be in a concordantly greater number to provide a potentially larger number of available letters for forming words, either to form longer words or a greater number of smaller words along the horizontal and vertical rows in a manner similar to the word arrangement shown in FIG. 14.

Assembly 20 thus provides a versatile combination of components to play a wide variety of word games, and especially those in which a significant element of chance is introduced by use of top 40 to determine completely randomly the nature and procedural operations performed in the game.

Accordingly, it can be appreciated that the specific embodiments described are merely illustrative of the general principles of the invention. Various modifications may be provided consistent with the principles set forth. For example, the play pieces can be circular instead of square or rectangular so as to facilitate rotation of the play pieces in embodiments of the invention which comprise overlay boards that are rotated in accordance with the rules of the game. After an overlay board is rotated then the play piece(s) thereon are rotated so as to make it easier to read the letter on each of these play pieces together with the letters on the non-rotated play pieces. Still further, the rotatable overlay boards may be essentially circular and may be positioned in a common plane with the non-rotatable portion of the play grid. Furthermore, the word game of the present invention can be implemented using a computer system that displays on a monitor a two dimensional view of the components of the word game(s) of the present invention. The rules and scoring of points can be programmed into the memory of the computer which can also be programed to implement the random selector and indicator means. A key board or mouse can be used to place a selected letter(s) at a desired location(s) on the grid displayed on the monitor.

What is claimed is:

1. A word game assembly for play by two or more players, comprising in combination:

a plurality of play boards, one for each of at least two players;

a supply of a plurality of individual alphabetical letter designating play pieces;

an associated overlay board provided on each play board for rotation relative thereto; and a player operated random selector and indicator means;

each play board defining a plurality of adjacent discrete areas arranged in a crosswise grid pattern of generally horizontal and vertical rows, each area being capable of receiving a corresponding play piece;

each play piece having a top side containing a single alphabetical letter designation and a bottom side;

each overlay board being of smaller size than its associated play board, and defining a series of adjacent discrete counterpart areas of complemental size and shape to the play board areas, the counterpart areas being arranged in a counterpart crosswise grid pattern of generally horizontal and vertical rows, each counterpart area being capable of receiving a corresponding play piece, the series of counterpart areas being smaller in number in each horizontal and vertical row than the plurality of areas of the associated play board, the overlay board being rotatable relative to the play board from one position of rotation in which the counterpart areas are individually superimposed on and aligned with respective ones of an equal number of corresponding areas therebelow on the associated play board to another position of rotation in which the counterpart areas are individually superimposed on and aligned with other respective ones of such equal number of the same corresponding areas therebelow on the play board; and the random selector and indicator means being operatable manually to select at random an individual one of a plurality of alternative play selections and to indicate the selected play selection, to permit a selective series of plays in which each player in turn operates the random selector and indicator means for successive play piece selection from the supply of play pieces, in dependence upon indicated play selection, and selected play piece location on an area of the play board or on a counterpart area of the associated overlay board of that player, subject to rotation of the overlay board from one position of rotation to another such position so as to change the arrangement of the areas and counterpart areas, also in dependence upon indicated play selection, in a competitive attempt to form words on the play board and its associated overlay board, in accordance with preassigned scoring values, consequent successive turns in the series of plays, the winner being the player having the highest value score at the end of the series of plays.

2. The assembly of claim 1 wherein the overlay board is rotatably secured to the play board by a resilient connector to permit lifting of the overlay board a selective height above the play board remote from any play pieces located thereon for rotation at that height.

3. The assembly of claim 1 wherein the overlay board is rotatably secured to the play board by a pivotal connector arranged to space the overlay board a selective height above the play board remote from any play pieces located thereon for rotation at that height.

4. The assembly of claim 1 wherein the overlay board is removably secured to the play board by a releasable band connector for rotation of the overlay board upon release of the band connector.

5. The assembly of claim 1 wherein each play board comprises a crosswise grid pattern of at least five corresponding horizontal and vertical rows of areas, and its associated overlay board comprises a counterpart crosswise grid pattern of at most three corresponding horizontal and vertical rows of counterpart areas, the overlay board being disposed generally centrally on the corresponding play board.

* * * * *